US005298001A

United States Patent [19]

Goodson

[11] Patent Number: 5,298,001

[45] Date of Patent: Mar. 29, 1994

[54] GYMNASTICS SAFETY GRIP APPARATUS

[75] Inventor: Mark P. Goodson, Kihei, Hi.

[73] Assignee: G. S. Grips, Inc., Roseburg, Oreg.

[21] Appl. No.: 929,979

[22] Filed: Aug. 14, 1992

[51] Int. Cl.[5] ..... A63B 26/00

[52] U.S. Cl. ..... 482/23; 482/48; 2/161.1; 2/162; 2/170; 2/917

[58] Field of Search ..... 2/160, 161 A, 161 R, 2/163, 19; 482/23, 48, 105, 106, 124; 602/22

[56] References Cited

U.S. PATENT DOCUMENTS

| | | | |
|---|---|---|---|
| 1,562,170 | 11/1925 | Latina | 2/19 |
| 3,417,840 | 12/1968 | Farnsworth, Jr. . | |
| 3,421,761 | 1/1969 | Grant | 602/22 |
| 3,721,996 | 3/1973 | Nadorf | 2/19 |
| 4,635,300 | 1/1987 | Rhec | 2/161 A |
| 4,665,561 | 5/1987 | Aoki | 2/19 |
| 4,698,850 | 10/1987 | Patton, Sr. et al. . | |
| 4,720,279 | 1/1988 | Fritschen et al. | 2/161 A |
| 4,793,005 | 12/1988 | Hetzel, Jr. . | |
| 4,796,306 | 1/1989 | Mitchell . | |
| 4,905,321 | 3/1990 | Walunga . | |
| 4,958,384 | 9/1990 | McCrane | 2/161 A |
| 5,004,231 | 4/1991 | Alread . | |

*Primary Examiner*—Richard J. Apley
*Assistant Examiner*—Jeanne M. Mollo
*Attorney, Agent, or Firm*—Edward B. Anderson

[57] ABSTRACT

A strap of leather, for extending along the palm of a user's hand, has a finger end and a wrist end, with the wrist end anchored to a pad secured around the wrist by a belt and held in place by hook and loop materials. The finger end of the strap has a dowel extending sideways at approximately the finger tip position. Beyond the dowel are a couple of holes through which the two middle fingers extend during use, with the distal end of the strap folded back over the dowel and the fingers extending through the holes. An elastic strip is attached to the palm face of the finger end of the strap and forms a pair of loops through which the fingers extend during use. The strip is attached to the finger end distally of the dowel and finger holes so that the fingers pass through the loops prior to being inserted in the holes.

2 Claims, 1 Drawing Sheet

GYMNASTICS SAFETY GRIP APPARATUS

BACKGROUND OF THE INVENTION

1. Field of the Invention

This invention relates to apparatus for improving the grips of gymnasts, and in particular, to such apparatus that engage the fingers and inhibit the release of the fingers during use.

2. Statement of Related Art

Gymnastics has during recent times become a popular sport. There are many different types of exercises in gymnastics. Some of the exercises are performed on uneven horizontal, parallel bars. During these exercises, the gymnast is holding onto one of two bars while swinging around it. This puts extensive strain on the gymnasts hands, and fingers in particular. In order to facilitate sliding of the hands around the bars during the exercises, the hands are typically treated to reduce the friction, such as by the addition of powder to the palms of the hands. This very act, however, also makes it difficult to hold onto the bars. This puts severe strains on the fingers, hands, wrists and forearms.

In order to improve the holding capability of the gymnast, a grip apparatus is conventionally used that includes a strap of leather that extends along the palm of the hand, with the wrist end of the strap anchored to a belt secured around the wrist. The finger end of the strap has a dowel or other small rod extending sideways at approximately the finger tip position. Beyond the dowel are a couple of holes through which the two middle fingers extend during use, with the distal end of the strap folded back over the dowel.

This grip apparatus adds to the strength and security of the gymnast's grip, but it also occasionally releases from the fingers during use. This makes the grip apparatus less effective, and even impairs the ability of the gymnast to grip well. Thus, although these grip apparatus are generally widely used, they are not completely satisfactory.

SUMMARY OF THE INVENTION

It has been found that this grip apparatus is more effective when made according to the present invention. The present invention adds means for inhibiting the release of the fingers once they are secured in the finger holes. In the preferred embodiment of the invention, this is provided by a strip attached to the palm face of the finger end and forming a pair of loops through which the fingers extend during use. The strip is attached to the finger end distally of the dowel and finger holes and is preferably made of a resilient material, such as elastic fabric, for urging the finger toward the palm face.

These elastic loops hold the finger against the palm strap with the fingers extending through the finger holes. The loops thus provide a frictional grip on the fingers that inhibits them from sliding out of the holes.

These and other features and advantages of the present invention will be apparent from the following detailed description of the preferred embodiment of the invention, described for purposes of illustration but not limitation, and as illustrated in the accompanying drawings.

DETAILED DESCRIPTION OF THE PREFERRED EMBODIMENT

Figure 1:
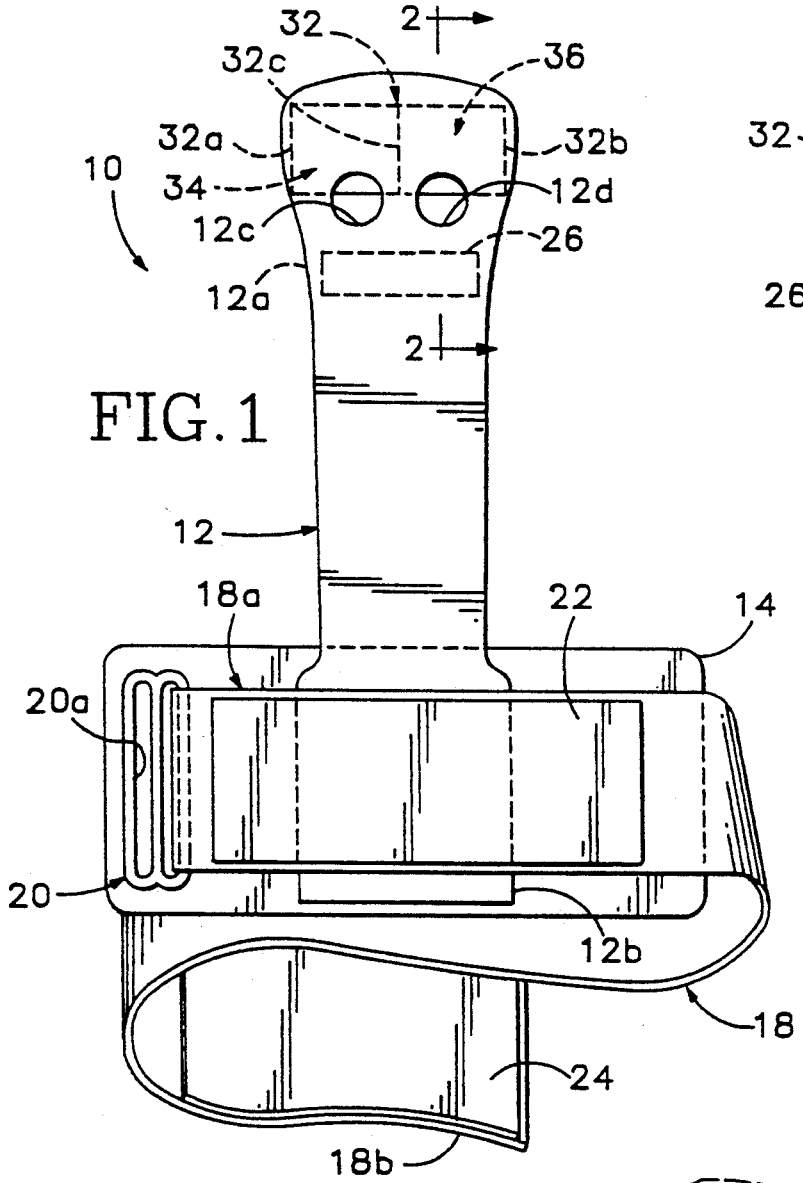
FIG. 1 is a view of the backside of a gymnastic grip apparatus made according to the invention.
Figure 2:
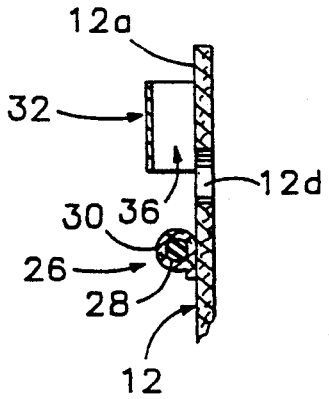
FIG. 2 is a partial cross-section taken along line 2—2 in FIG. 1 showing the structure of the finger end of the palm strap.

Referring initially to FIGS. 1 and 2, a gymnastics safety grip apparatus, referred to generally as a grip apparatus 10, includes an elongate palm strap 12 having a finger end **12*a* and a wrist end 12*b*. The wrist strap is preferably made of high grade leather or other equivalently strong and flexible material. Disposed in the finger end are a couple of laterally spaced-apart finger holes 12*c* and 12*d***.

Figure 3:
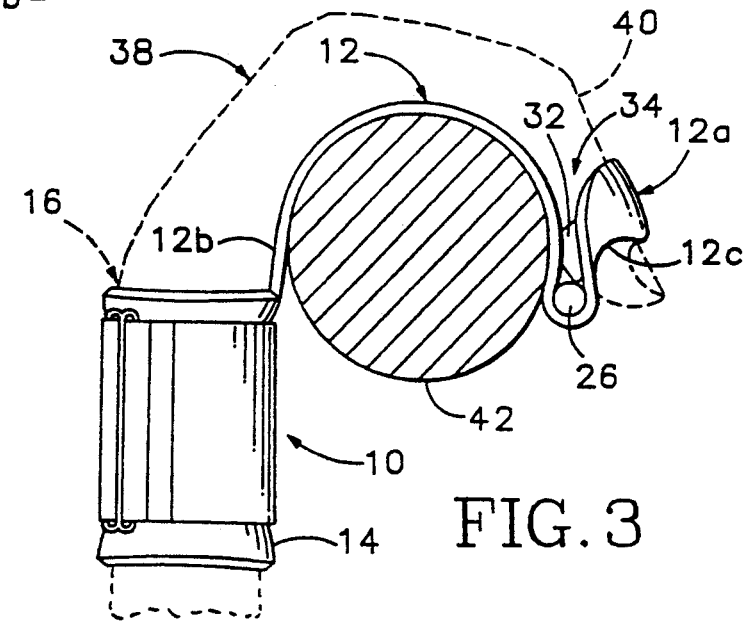
FIG. 3 is a side view of the grip apparatus of FIG. 1 during use.

An elongate wrist pad 14 is attached to the palm strap wrist end, such as by sewing, to extend laterally of the palm strap so that it can be wrapped around the wrist 16 of a user, as shown in FIG. 3. The pad is preferably made of a durable resilient foam material, such as neoprene. An end **18*a* of a wrist belt 18 is attached along the length of the pad, with the extreme end having a buckle 20 with an open loop 20*a* attached to it, as shown. On the exposed face of end 18*a* of the belt is a patch 22 of a first one of hook and loop materials. The other or free end 18*b* of the belt has a compatible patch 24 made of the corresponding other of the hook and loop materials. When worn by a user, as shown in FIG. 3, the free end 18*b* of the belt is fed through open loop 20*a*** and turned back onto itself so that the hook and loop materials overlap, holding the belt securely on the user's wrist.

Attached to finger end **12*a* of the palm strap is a preferable firm, but resilient rod or dowel 26. This dowel extends laterally of the strap and is positioned proximally, relative to the wrist end, of the finger holes. Dowel 26 preferably is at least as long as the opposite sides of the two finger holes, so that the two fingers of the user are supported on the dowel, as shown in FIG. 3. As shown particularly in FIG. 2, dowel 26 includes a rubber core 28 and a leather sleeve 30** which is attached to the palm strap, such as by sewing.

Attached to the same face of the palm strap as the dowel are means for inhibiting the removal of fingers from the finger holes. This is provided by an elastic strip 32 sewn onto the distal end of the finger end of the palm strap so that it extends laterally of the strap with the finger holes slightly covered, as shown. The strip is attached at opposite ends **32*a* and 32*b*, and at an intermediate region 32*c*, so that two loops 34 and 36 are formed in line with finger holes 12*c* and 12*d*. These loops should be sized to require stretching in order for the fingers of a user to fit through them. They are positioned so that the fingers pass through the loops before being inserted through the holes. The fingers are thereby held against strap 12** when the finger tips extend through the finger holes.

FIG. 3 illustrates, as a simplified side view, how grip 10 is used. The user's hand 38, connected to wrist 16, has fingers, such as finger 40, that extend through the finger holes, such as hole **12*c*, with the loops of elastic strip 32, such as loop 34, extending around them. Palm strap 12 extends along the palm of hand 38 with belt 18** securing the palm strap and wrist pad on wrist 16. Grip apparatus 10 thus supports the hand of the user when gripping a bar 42 shown in cross section.

A grip apparatus 10 made according to the present invention thus provides improved security and dependability to a gymnast by inhibiting the release of the finger end of the grip from the fingers. The preferred embodiment in fact has been known so far to always stay on the fingers of the user during use.

It will be apparent to one skilled in the art that variations in form and detail may be made in the preferred embodiment without varying from the spirit and scope of the invention as defined in the claims any modification of the claim language or meaning as provided under the doctrine of equivalents. The preferred embodiment is thus provided for purposes of explanation and illustration, but not limitation.

I claim:

1. A gymnastics safety grip apparatus comprising an elongate palm element made of a material allowing slippage on a gymnastics bar during use and having a palm face against which the palm of a user faces during use, a bar face opposite from the palm face for contacting the gymnastics bar, a wrist end and a finger end, the finger end having at least one finger hole for receiving the two middle fingers of a hand of a user, the finger end extending beyond the at least one finger hole, a wrist strap attached to the wrist end for securing the palm element to the wrist of a user, a rod member attached along one edge to the palm face of the finger end to extend laterally along the palm element and at a position adjacent to and toward the wrist end from the at least one finger hole, the finger end of the palm element extending freely beyond the rod member, and a resilient finger strap attached to the finger end of the palm face of the palm element distally of and adjacent to the at least one finger hole, the finger strap frictionally holding the tips of the two middle fingers of the hand of a user against the palm element with the distal end of the palm face of the palm element wrapped around the rod member with the palm side of the finger tips extending between the overlapping palm faces of the palm element, through the finger straps and through the finger holes adjacent to the rod member, whereby the fingers are held in position by both the at least one finger hole and the resilient finger strap.

2. A gymnastics grip apparatus according to claim 1 wherein the palm element has a width adapted to be greater than the width of the two middle fingers of the hand of a user and the wrist strap extends fully around the wrist of a user and has a width corresponding to the width of the palm element.

* * * * *